US009114522B1

(12) United States Patent
Bond

(10) Patent No.: US 9,114,522 B1
(45) **Date of Patent: *Aug. 25, 2015**

(54) MAGNETIC BIT HOLDER OR DRIVER WITH SWITCH

(71) Applicant: Jared Bond, Oklahoma City, OK (US)

(72) Inventor: Jared Bond, Oklahoma City, OK (US)

( * ) Notice: Subject to any disclaimer, the term of this patent is extended or adjusted under 35 U.S.C. 154(b) by 221 days.

This patent is subject to a terminal disclaimer.

(21) Appl. No.: 13/912,428

(22) Filed: Jun. 7, 2013

Related U.S. Application Data

(63) Continuation-in-part of application No. 12/715,465, filed on Mar. 2, 2010, now Pat. No. 8,468,913.

(51) Int. Cl.
*B25F 1/02* (2006.01)

(52) U.S. Cl.
CPC ..... *B25F 1/02* (2013.01)

(58) Field of Classification Search
CPC ..... B25F 1/02; B25B 15/00; B25B 15/02; B25B 23/0035; B25B 23/12
See application file for complete search history.

(56) References Cited

U.S. PATENT DOCUMENTS

| | | | | |
|---|---|---|---|---|
| 3,222,959 | A * | 12/1965 | Clark | 81/124.6 |
| 4,434,828 | A | 3/1984 | Trincia | |
| 4,827,812 | A | 5/1989 | Markovetz | |
| 4,850,758 | A | 7/1989 | Morgan | |
| 5,014,379 | A | 5/1991 | Hull et al. | |
| 5,606,758 | A | 3/1997 | Tung | |
| 6,318,218 | B1 | 11/2001 | Anderson et al. | |
| 6,325,577 | B1 | 12/2001 | Anderson | |
| 6,401,576 | B1 | 6/2002 | Wu | |
| 6,425,307 | B1 | 7/2002 | Chen | |
| 6,725,486 | B2 | 4/2004 | Oka | |
| 6,739,226 | B2 | 5/2004 | Beauchamp | |
| 6,745,850 | B2 | 6/2004 | Hahn | |
| 6,997,086 | B1 | 2/2006 | Graham | |
| 7,162,758 | B2 | 1/2007 | Skinner | |
| 7,281,455 | B2 | 10/2007 | Hu | |
| 7,922,180 | B2 | 4/2011 | Meng | |
| 8,240,233 | B2 | 8/2012 | Huang | |
| 8,468,913 | B1 * | 6/2013 | Bond | 81/52 |
| 2003/0213343 | A1 | 11/2003 | Schuster | |
| 2004/0231468 | A1 | 11/2004 | Odachawski | |
| 2008/0223182 | A1 | 9/2008 | Hamon | |
| 2008/0276765 | A1 | 11/2008 | Johnson et al. | |
| 2009/0188352 | A1 | 7/2009 | Huang | |
| 2010/0282034 | A1 | 11/2010 | Huang | |

FOREIGN PATENT DOCUMENTS

| | | |
|---|---|---|
| JP | 2003311641 | 11/2003 |

* cited by examiner

*Primary Examiner* — David B Thomas
(74) *Attorney, Agent, or Firm* — Gable Gotwals

(57) ABSTRACT

The disclosure provides devices and methods for magnetizing or demagnetizing a bit inserted in a bit holder without removing the bit from the bit holder. The disclosure also provides devices and methods for magnetizing or demagnetizing a socket of a driver so that a fastener can be properly seated within the socket. More particularly, the invention includes a bit holder or driver with a cavity containing a magnet. The magnet may be attached to a switch, which allows the magnet to be manually moved within the cavity to an "on" or an "off" position. The bit or driver may be magnetized when the magnet is in the "on" position and demagnetized when the magnet is in the "off" position.

20 Claims, 5 Drawing Sheets

MAGNETIC BIT HOLDER OR DRIVER WITH SWITCH

CROSS REFERENCE TO RELATED APPLICATIONS

This application is a continuation-in-part application of U.S. patent application Ser. No. 12/715,465, filed Mar. 2, 2010, the contents of which are hereby incorporated by reference in their entirety.

BACKGROUND OF THE INVENTION

The present invention relates to a bit holder which contains a movable magnet such that a bit inserted in the bit holder may be magnetized or demagnetized without removing it from the bit holder. The present invention also relates to a driver which contains a movable magnet, thereby facilitating the removal of metallic debris from the socket of the driver and allowing the fastener to be seated properly within the socket.

Screws are commonly used as fasteners in a variety of applications. Tools such as drills have been developed for placing or removing screws. However, the tool may slip off the head of the screw, potentially damaging the base material or causing injury. In addition, the screw may be lost or damaged. A magnetic bit or bit holder may be used to keep the screw in the proper position on the tip of the bit as the screw is placed. A magnetic bit or bit holder may also be used to retain the screw on the tip of the bit as the screw is removed, facilitating the screw's reuse or proper disposal. A magnetic bit or bit holder may also allow the operator to drive the screw with one hand, facilitating work in tight places or allowing the operator to perform multiple tasks at the same time.

However, if the magnetic bit or bit holder is used to place a screw in a metallic base material, metal splinters may collect on the bit, making it difficult to fit the next screw onto the tip of the bit. Metal splinters may also come from the screw if the bit slips after the screw is driven home but before the operator stops the tool. For example, self-tapping screws, which are frequently used in the construction industry, generate significant quantities of such splinters. Removal of these splinters is time-consuming, reducing efficiency and productivity, and often requires that operators remove their work gloves in cold, wet, or hazardous locations. Allowing the accumulated metal splinters to remain on the bit may cause the bit to slip off the head of the screw, resulting in damage to the bit or tool, damage to the base material, or injury.

As can be seen, there is a need for a bit holder that provides the advantages of a magnetic bit while allowing the safe and quick removal of metal splinters that accumulate on the bit as screws are placed. There is also a need for a driver with a movable magnet to permit the safe and quick removal of metallic debris from the socket of the driver, which allows a fastener to be properly seated in the driver and correctly placed in the base material.

SUMMARY OF THE INVENTION

According to one embodiment of the invention, a magnetic bit holder with a switch is provided, where the magnetic bit holder is comprised of a bit holder having a shank, a body, and a socket; a cavity inside the body; a magnet inside the cavity; a conductor located between the cavity and the socket; and a switch which is adapted to move the magnet within the cavity. The switch may be comprised of a guiding bar, longitudinal grooves on opposite sides of the body of the bit holder, and a sleeve that surrounds a portion of the body of the bit holder. In an alternative embodiment, the switch may be comprised of a spring and a push button. In another embodiment, the switch may be comprised of a guiding bar, a longitudinal groove in the body of the bit holder, and a thumb grip.

According to still another embodiment of the invention, a method of using a magnetic bit holder is provided. The method comprises the steps of providing a bit holder having a shank, a body, and a socket, wherein the body is comprised of a cavity, a magnet inside the cavity, and a conductor; placing the bit into the socket; magnetizing the bit by positioning a switch so that the magnet is adjacent to the conductor; using the bit to manipulate a screw; demagnetizing the bit by positioning the switch so that the magnet is not adjacent to the conductor; and allowing metal splinters to fall from the bit.

According to still another embodiment of the invention, a switch for moving a magnet within the body of a magnetic bit holder is provided. The switch may be comprised of a guiding bar located in a hole in the magnet, longitudinal grooves in the body of the bit holder, and a sleeve which surrounds a portion of the body. Each end of the guiding bar extends through a longitudinal groove and attaches to the sleeve, while a stopping mechanism prevents the sleeve from sliding too far toward the shank or the socket and damaging the switch.

According to still another embodiment of the invention, a switch for moving a magnet within the cavity of the body of a magnetic bit holder is provided. The switch may be comprised of a magnet carrier located in the cavity between the conductor and the magnet, a guiding bar located in a hole in the magnet carrier, longitudinal grooves in the body of the bit holder, and a sleeve which surrounds a portion of the body. Each end of the guiding bar extends through a longitudinal groove and attaches to the sleeve. Magnetic force attracts the magnet to the magnet carrier so that the magnet and magnet carrier move as a unit within the cavity.

According to still another embodiment of the invention, a switch for moving a magnet within the cavity of the body of a magnetic bit holder is provided. The switch may be comprised of a magnet carrier located in the cavity between the conductor and the magnet, a guiding bar located in a hole in the magnet carrier, a longitudinal groove in the body of the bit holder through which the end of the guiding bar extends, and a thump grip which slides along the body and attaches to the end of the guiding bar. Magnetic force attracts the magnet to the magnet carrier so that the magnet and magnet carrier move as a unit within the cavity.

According to still another embodiment of the invention, a magnetic driver with a switch is provided, where the magnetic driver is comprised of a driver having a shank, a body, and a socket configured to receive a fastener; a cavity inside the body; a magnet inside the cavity; a conductor located between the cavity and the socket; and a switch which is adapted to move the magnet within the cavity. The switch may be comprised of a guiding bar, longitudinal grooves on opposite sides of the body of the driver, and a sleeve that surrounds a portion of the body of the driver. In an alternative embodiment, the switch may be comprised of a spring and a push button. In another embodiment, the switch may be comprised of a guiding bar, a longitudinal groove in the body of the driver, and a thumb grip. In another embodiment, the switch may be comprised of a magnet carrier, a guiding bar, longitudinal grooves on opposite sides of the body of the driver, and a sleeve that surrounds a portion of the body of the driver. In another embodiment, the switch may be comprised of a magnet carrier, a guiding bar, a longitudinal groove on one side of the driver, and a thumb grip.

According to still another embodiment of the invention, a method of using a magnetic driver is provided. The method comprises the steps of providing a driver having a shank, a body, and a socket configured to receive a fastener, wherein the body is comprised of a cavity, a magnet inside the cavity, and a conductor; demagnetizing the socket by positioning a switch so that the magnet is not adjacent to the conductor; allowing metallic debris to fall from the socket; placing the fastener into the socket; magnetizing the socket by positioning the switch so that the magnet is adjacent to the conductor; and using the driver to manipulate the fastener. The switch may be comprised of a guiding bar, longitudinal grooves on opposite sides of the body of the driver, and a sleeve that surrounds a portion of the body of the driver. In another embodiment, the switch may be comprised of a magnet carrier, a guiding bar, longitudinal grooves on opposite sides of the body of the driver, and a sleeve that surrounds a portion of the body of the driver. In an alternative embodiment, the switch may be comprised of a spring and a push button. In another embodiment, the switch may be comprised of a guiding bar, a longitudinal groove in the body of the driver, and a thumb grip.

These and other features, aspects, and advantages of the present invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the current invention includes devices and methods for magnetizing or demagnetizing a bit inserted in a bit holder without removing the bit from the bit holder. More particularly, an embodiment of the invention may comprise a bit holder containing a cavity. The cavity may contain a magnet controlled by a switch that allows the magnet to move within the cavity and to be placed into an "on" or an "off" position. When the magnet is placed in the "on" position, the bit in the bit holder is magnetized in order to retain metallic screws in engagement with the tip of the bit; however, such magnetization also attracts any metal splinters that might be produced while operating the tool. When the magnet is placed in the "off" position, the bit in the bit holder is demagnetized, facilitating the removal of metal splinters that have accumulated on the bit without requiring that the bit be removed from the bit holder.

Figure 1:
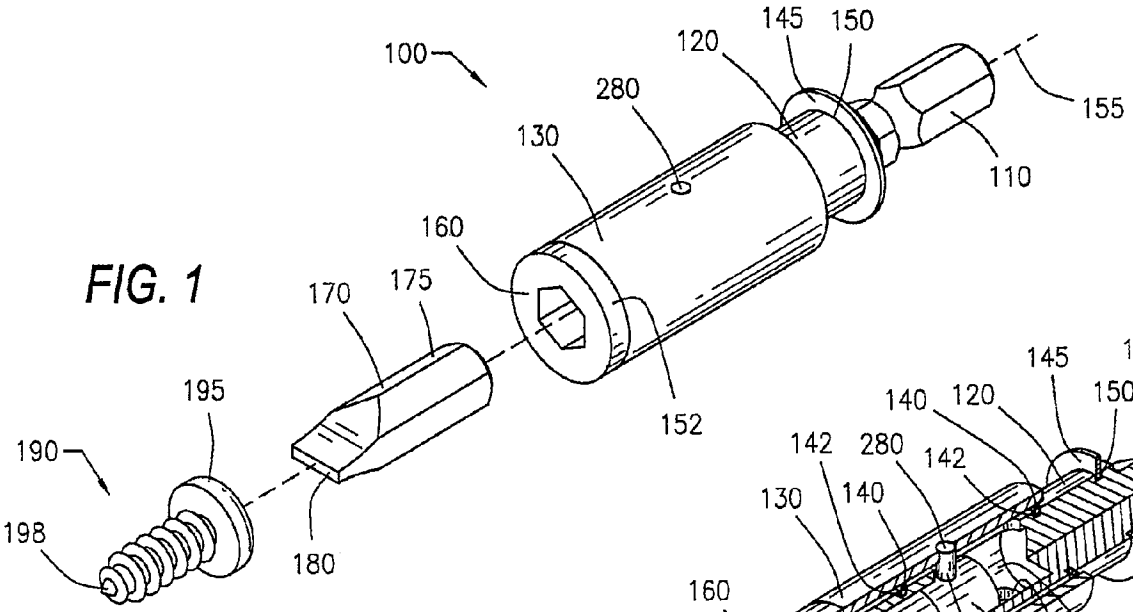
FIG. 1 shows a perspective view of an embodiment of the invention.

Referring now to FIG. 1, an embodiment of the invention may be seen in perspective. The embodiment may comprise a bit holder 100 with a shank 110, a body 120, and a socket 160. The shank 110 may be located at one end of the bit holder 100 and may be inserted into a drill or other tool. The body 120 of the bit holder 100 may be located between the shank 110 and the socket 160. The socket 160 may be located at the opposite end of the bit holder 100 from the shank 110 and may receive a head 175 of a bit 170. A tip 180 of the bit 170 may be formed for engagement with a corresponding configuration of grooves in a head 195 of a screw 190, while a tip 198 of the screw 190 may be positioned against the base material to be fastened. The nature of the configuration of grooves in the head 195 of the screw 190 is not significant to the inventive concept. Although a slotted screw is shown, other configurations such as a Phillips head or square-drive head may be used without departing from the scope of the invention.

A portion of the body 120 of the bit holder 100 may be surrounded by a sleeve 130. The sleeve 130 may be comprised of metal, including but not limited to steel or tool-grade steel. The movement of the sleeve 130 may be limited by a stopping mechanism. For example, the sleeve's 130 movement toward the shank 110 of the bit holder 100 may be limited by a C-ring 145 inserted into a circular groove 150 on the body 120 of the bit holder 100. As another example, the body 120 of the bit holder 100 may be formed with a slight shoulder 152, such that the sleeve 130 is stopped by the shoulder 152 as it moves toward the socket 160 of the bit holder 100. Using shoulders as a stopping mechanism may reduce the number of separate parts in the bit holder 100, thus simplifying production and further prolonging the useful life of the bit holder 100. However, the stopping mechanism may be comprised of any other reasonable components. The sleeve 130 may be partially or completely surrounded with a grip (not shown) made of rubber or another material to facilitate handling.

Figure 2:
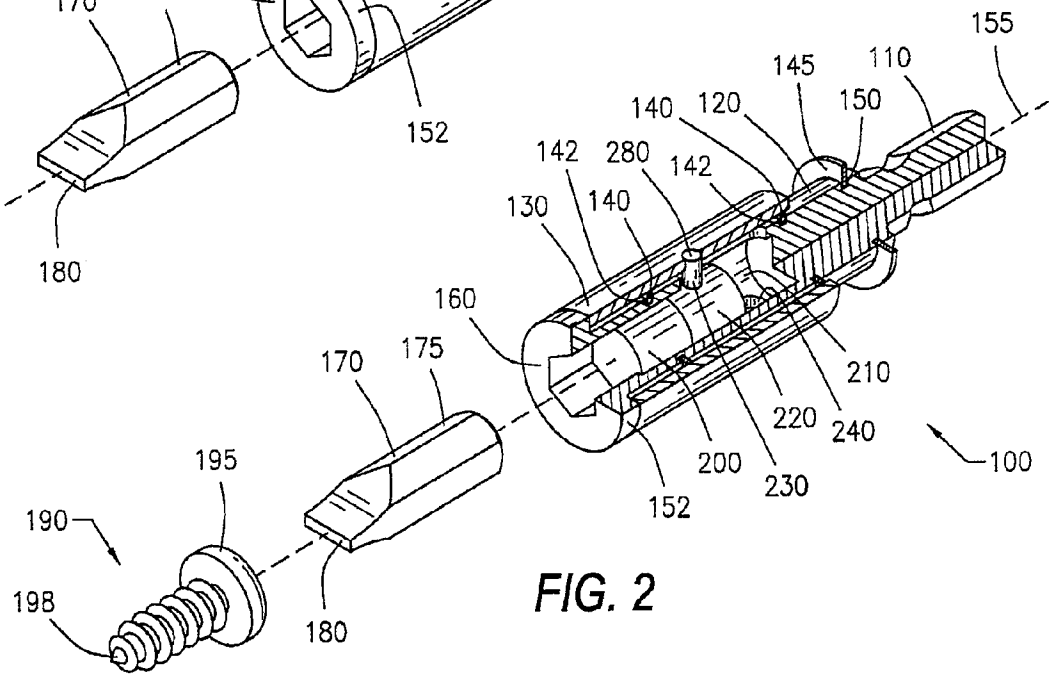
FIG. 2 shows a perspective view of a portion of the internal structure of an embodiment of the invention.

Referring now to FIG. 2, a portion of the internal structure of an embodiment of the invention may be seen in perspective. There may be a cavity 210 inside the body 120 of the bit holder 100, which may contain a magnet 220 attached to a switch. As described below, the switch may comprise a guiding bar 230 with guiding bar ends 280, longitudinal grooves 240, and the sleeve 130. The guiding bar 230 is a straight piece of metal, plastic, wood, or other reasonable material that is longer than it is wide. The shape of the cross-sectional area of the guiding bar 230 may be, but is not limited to, spherical, square, rectangular, or oval. A conductor 200 may be located between the socket 160, which receives the bit 170, and the cavity 210. The conductor 200 may be comprised of a material, including but not limited to steel, that transmits magnetic force from the magnet 220 to the bit 170 only when the magnet 220 is abutting the conductor 200. Thus, in the "on" position, the magnet 220 may be in contact with or adjacent to the conductor 200, magnetizing the bit 170 in the socket 160. However, in the "off" position, the magnet 220 may not be in contact with or adjacent to the conductor 200, demagnetizing the bit 170.

The sleeve 130 is separated from the body 120 of the bit holder 100 by internal c-rings 140, which may be inserted into circular grooves 142 on the body 120 of the bit holder 100. The internal c-rings 140 may allow the sleeve 130 to slide longitudinally along the axis 155 of the body 120 of the bit holder 100. The internal c-rings 140 also serve to prevent dirt, dust, and other contaminants from entering the space between the body 120 of the bit holder 100 and the sleeve 130, therefore prolonging the useful life of the bit holder 100.

Figure 3:
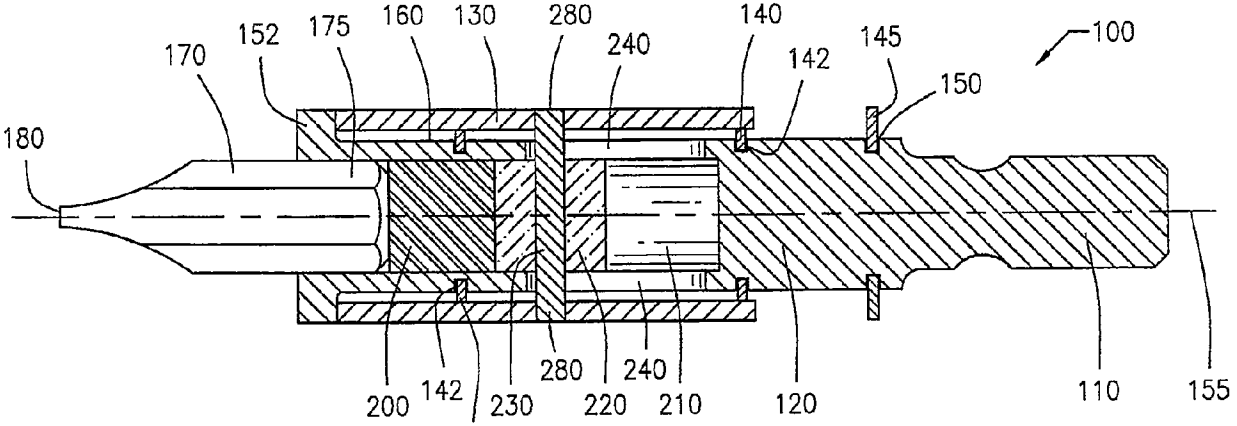
FIG. 3 shows a cross-section view of an embodiment of the invention with the magnet in the "on" position.

Referring now to FIG. 3, an embodiment of the invention may be seen in cross-section when the magnet 220 has been placed in the "on" position. In this embodiment, the switch may consist of a guiding bar 230, longitudinal grooves 240 on opposite sides of the body 120 of the bit holder 100, and the sleeve 130. Each longitudinal groove 240 may have a length equal to or less than the length of the cavity 210 and a width slightly greater than the circumference of the guiding bar 230. The guiding bar 230 may be inserted into a hole in the center of the magnet 220 that extends across the width of the magnet 220. The guiding bar 230 may be connected to the magnet 220 by threading, epoxy, threading and epoxy, pressure fitting, or any other reasonable method. The manner in which the guiding bar 230 is connected to the magnet 220 is not essential to the invention, and any suitable method may be used and still be within the scope of the invention. Each end 280 of the guiding bar 230 may extend through a longitudinal groove 240 and may be connected to the sleeve 130 by threading, tack welding, pressure fitting, or any other reasonable method. Thus, when the operator slides the sleeve 130 toward the socket 160 of the bit holder 100, the magnet 220 may be placed in contact with or adjacent to the conductor 200, which magnetizes the bit 170.

Figure 4:
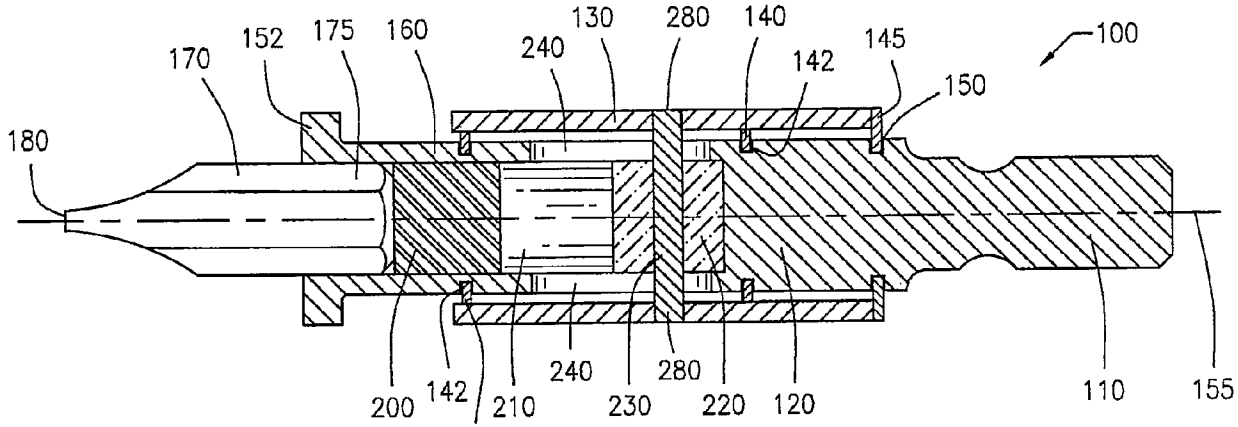
FIG. 4 shows a cross-section view of an embodiment of the invention with the magnet in the "off" position.

Referring now to FIG. 4, an embodiment of the invention may be seen in cross-section when the magnet 220 has been placed in the "off" position. Once again, the switch may consist of a guiding bar 230, longitudinal grooves 240 on opposite sides of the body 120 of the bit holder 100, and the sleeve 130. In order to demagnetize the bit 170, the operator may slide the sleeve 130 toward the shank 110 of the bit holder 100. Moving the sleeve 130 toward the shank 110 may move the magnet 220 away from the conductor 200, which demagnetizes the bit 170.

Figure 5:
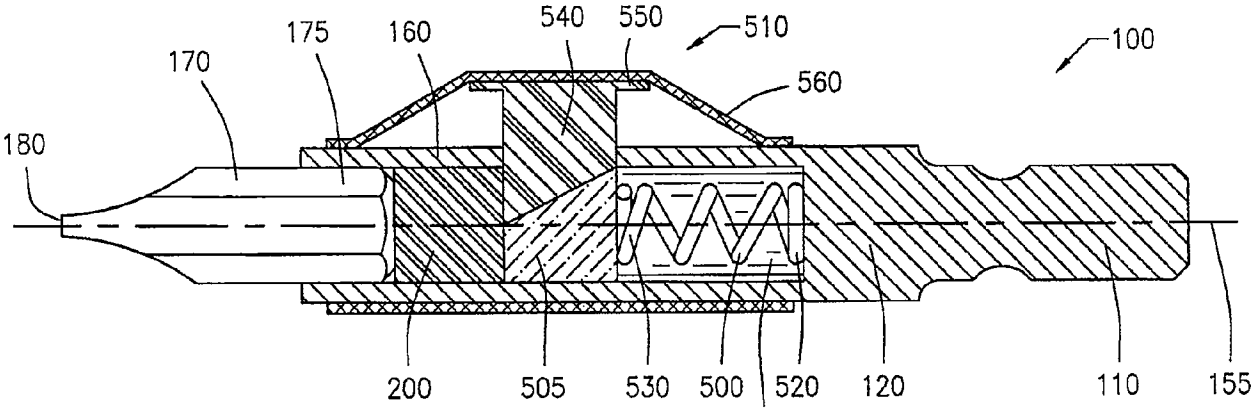
FIG. 5 shows a cross-section view of an embodiment of the invention with the magnet in the "on" position.

Referring now to FIG. 5, an embodiment of the invention may be seen in cross-section when the magnet 505 has been placed in the "on" position. There may be a cavity 515 inside the body 120 of the bit holder 100, which may contain a magnet 505 that has been angled so that one side of the magnet 505 is in contact with the switch. A conductor 200 may be located between the socket 160, which receives the bit 170, and the cavity 515. The conductor 200 may be comprised of a material, including but not limited to steel, that transmits magnetic force from the magnet 505 to the bit 170 only when the magnet 505 is adjacent to the conductor 200. Thus, when the magnet 505 is placed in the "on" position, the magnet 505 may be in contact with the conductor 200, which magnetizes the bit 170.

A portion of the body 120 of the bit holder 100 may be surrounded by a covering 560. The covering 560 may be comprised of a material, including but not limited to plastic or rubber, that retains its shape while holding the switch in place. The covering 560 may also serve as a grip to make the embodiment easier for the operator to handle and use.

In this embodiment, the switch may be comprised of a spring 500 and a push button 510. The spring 500 may be located in the cavity 515 of the body 120 of the bit holder 100. One end 520 of the spring 500 may be attached to the body 120 of the bit holder 100 by tack welds, epoxy, or any other reasonable method. The opposite end 530 of the spring 500 may be in contact with, but may not be attached to, another side of the magnet 505. The push button 510 may be comprised of a push button stem 540, which extends through an opening in one side of the body 120 of the bit holder 100, and a push button head 550. The end of the push button stem 540 that is opposite the push button head 550 may be formed at an angle that complements the angle of the magnet 505 so that the push button stem 540 and the magnet 505 fit against each other. When the operator does not press the push button 510 toward the body 120 of the bit holder 100, the spring 500 may not be compressed. The magnet 505 may thus remain in contact with the conductor 200, magnetizing the bit 170.

Figure 6:
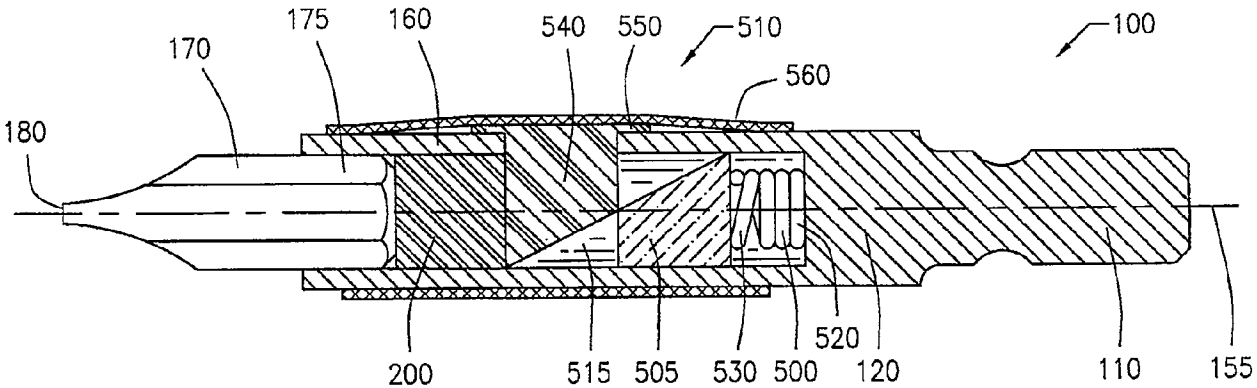
FIG. 6 shows a cross-section view of an embodiment of the invention with the magnet in the "off" position.

Referring now to FIG. 6, an embodiment of the invention may be seen in cross-section when the magnet 505 has been placed in the "off" position. As described above, the switch may consist of a spring 500 and a push button 510. In order to demagnetize the bit 170, the operator may press the push button 510 toward the body 120 of the bit holder 100. The end of the push button stem 540 opposite the push button head 550 may exert force against the magnet 505, displacing the magnet 505 into the cavity 515 and compressing the spring 500. The push button stem 540 may thus be inserted between the magnet 505 and the conductor 200, which demagnetizes the bit 170. The conductor 200 and the bit 170 may remain demagnetized as long as the operator continues to press the push button 510. Once the operator releases the push button 510, the spring 500 may decompress and may move the magnet 505 so that the magnet 505 is in contact with or adjacent to the conductor 200.

Figure 7:
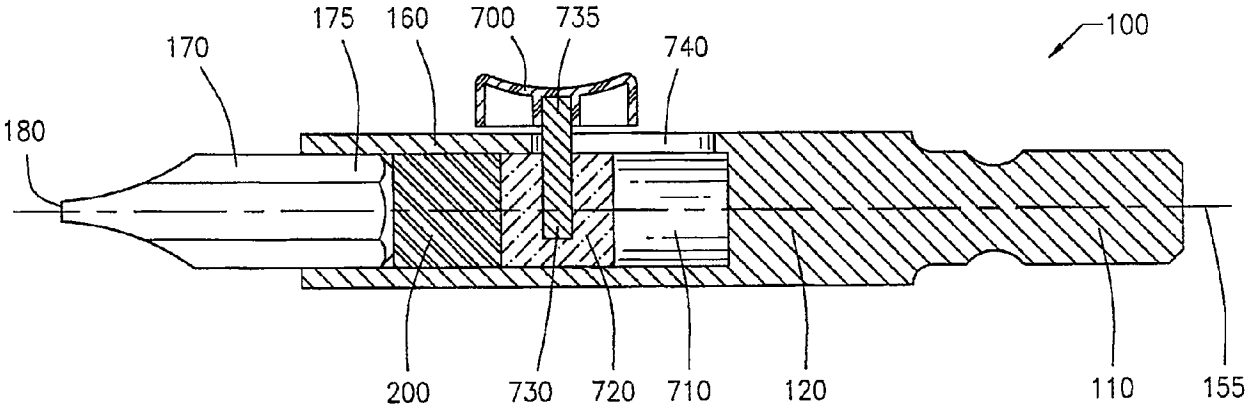
FIG. 7 shows a cross-section view of an embodiment of the invention with the magnet in the "on" position.

Referring now to FIG. 7, an embodiment of the invention may be seen in cross-section when the magnet 720 has been placed in the "on" position. There may be a cavity 710 inside the body 120 of the bit holder 100, which may contain a magnet 720 attached to a switch. A conductor 200 may be located between the socket 160, which receives the bit 170, and the cavity 710. The conductor 200 may be comprised of a material, including but not limited to steel, that transmits magnetic force from the magnet 720 to the bit 170 only when the magnet 720 is in contact with or adjacent to the conductor 200. Thus, when the magnet 720 is placed in the "on" position, the magnet 720 may be in contact with or adjacent to the conductor 200, which magnetizes the bit 170.

In this embodiment, the switch may consist of a guiding bar 730, a longitudinal groove 740 on one side of the bit holder 100, and a thumb grip 700. The thumb grip 700 may be made of various materials, including but not limited to metal, plastic, or rubber. The longitudinal groove 740 may have a length equal to or less than the length of the cavity 710 and a width slightly greater than the circumference of the guiding bar 730. The guiding bar 730 may be comprised of metal, including but not limited to steel or tool-grade steel. The guiding bar 730 may be inserted into a hole in the center of the magnet 720. The guiding bar 730 may be connected to the magnet 720 by threading, epoxy, threading and epoxy, pressure fitting, or any other reasonable method. One end 735 of the guiding bar 730 may extend through the longitudinal groove 740 and may be connected to the thumb grip 700 by threading, tack welding, pressure fitting, or any other reasonable method. Thus, when the operator slides the thumb grip 700 toward the socket 160 of the bit holder 100, the magnet 720 may be placed near or adjacent to the conductor 200, which magnetizes the bit 170.

Figure 8:
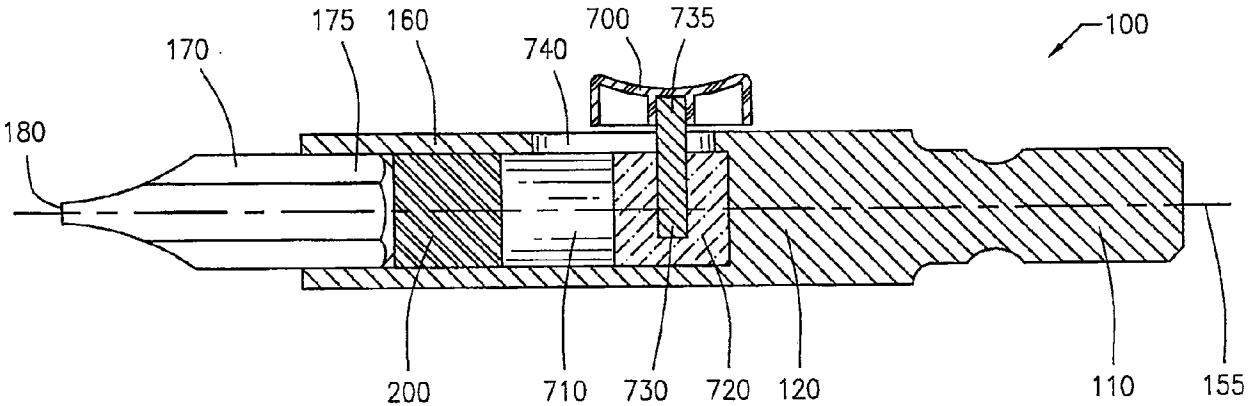
FIG. 8 shows a cross-section view of an embodiment of the invention with the magnet in the "off" position.

Referring now to FIG. 8, an embodiment of the invention may be seen in cross-section when the magnet 720 has been placed in the "off" position. Once again, the switch may consist of a guiding bar 730, a longitudinal groove 740 on one side of the bit holder 100, and a thumb grip 700. In order to demagnetize the bit 170, the operator may slide the thumb grip 700 toward the shank 110 of the bit holder 100. Moving the thumb grip 700 toward the shank 110 may move the magnet 720 away from the conductor 200, which may demagnetize the bit 170.

Figure 9:
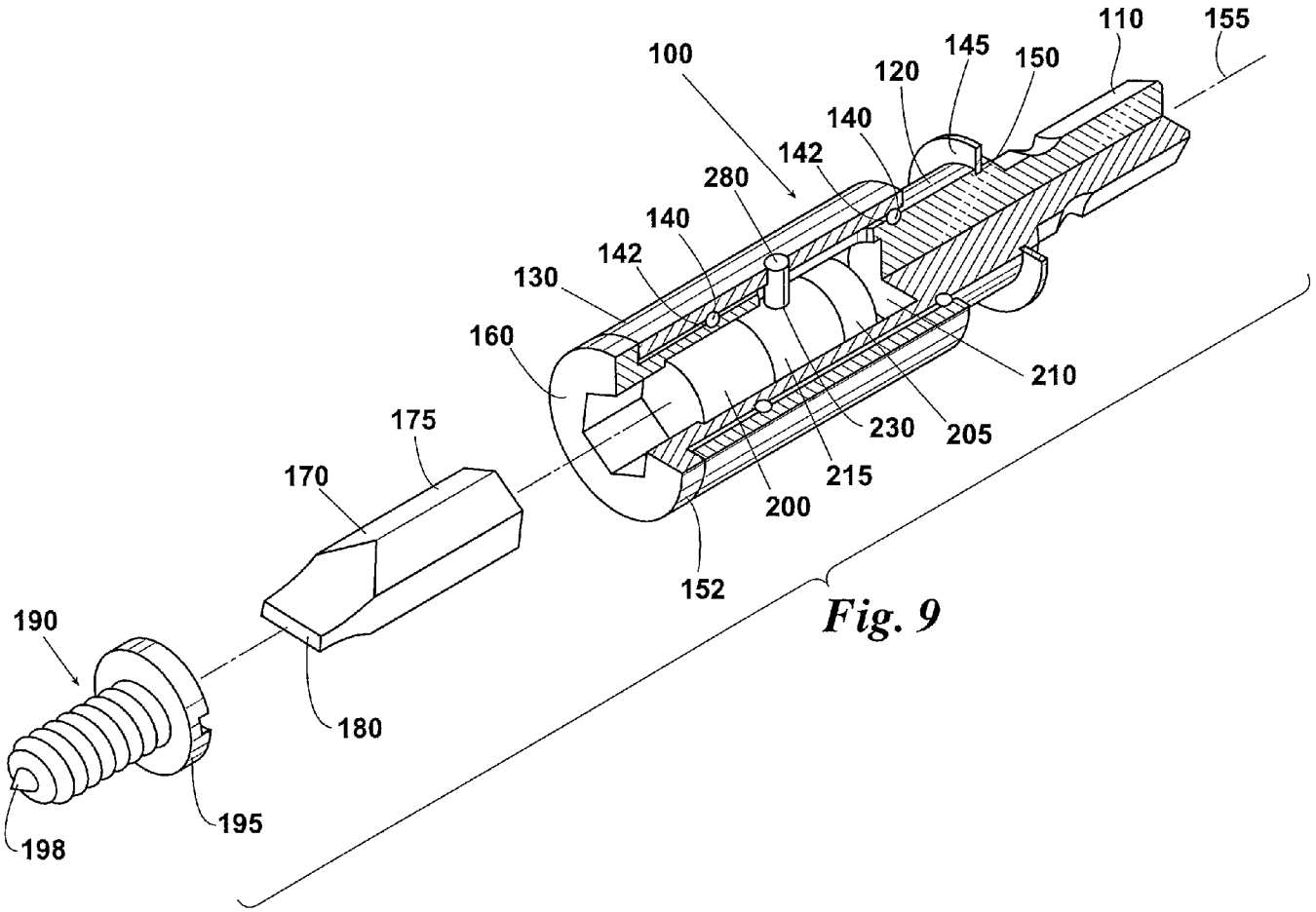
FIG. 9 shows a perspective view of a portion of the internal structure of an embodiment of the invention.

Referring now to FIG. 9, a portion of the internal structure of an alternate embodiment of the invention may be seen in perspective. There may be a cavity 210 inside the body 120 of the bit holder 100, which may contain a magnet 205 attached to a switch by magnetic force. A conductor 200 may be located between the socket 160, which receives the bit 170, and the cavity 210. The conductor 200 may be comprised of a material, including but not limited to steel, that transmits magnetic force from the magnet 205 to the bit 170 only when the switch is abutting the conductor 200. Thus, in the "on" position, the magnet 205 may be in contact with the switch, which is in contact with or adjacent to the conductor 200, thereby magnetizing the bit 170 in the socket 160. However, in the "off" position, the magnet 205 and switch may not be in contact with or adjacent to the conductor 200, demagnetizing the bit 170.

In an embodiment of the invention, the switch may comprise a magnet carrier 215 located within the cavity 210 and between the conductor 200 and the magnet 205, a guiding bar 230, longitudinal grooves on opposite sides of the body 120 of the bit holder 100, and the sleeve 130. The magnet carrier 215 may be comprised of a material, including but not limited to steel. Magnetic force attracts the magnet 205 to the magnet carrier 215 so that the magnet 205 and magnet carrier 215 move as a single unit within the cavity 210. Magnetic force from the magnet 205 may also be transmitted through the magnet carrier 215 to the conductor 200 and ultimately through the conductor 200 to the bit 170. The guiding bar 230 may be a straight piece of metal, plastic, wood, or other reasonable material that is longer than it is wide. The shape of the cross-sectional area of the guiding bar 230 may be, but is not limited to, spherical, square, rectangular, or oval. Each longitudinal groove may have a length less than the length of the cavity 210 and a width slightly greater than the circumference of the guiding bar 230.

The guiding bar 230 may be inserted into a hole in the center of the magnet carrier 215 that extends across the width of the magnet carrier 215. The guiding bar 230 may be connected to the magnet carrier 215 by threading, epoxy, threading and epoxy, pressure fitting, or any other reasonable method. The manner in which the guiding bar 230 is connected to the magnet carrier 215 is not essential to the invention, and any suitable method may be used and still be within the scope of the invention. Each end 280 of the guiding bar 230 may extend through a longitudinal groove and may be connected to the sleeve 130 by threading, tack welding, pressure fitting, or any other reasonable method. Thus, when the operator slides the sleeve 130 toward the socket 160 of the bit holder 100, the magnet carrier 215 may be placed in contact with or adjacent to the conductor 200, and magnetic force from the magnet 205 may be transmitted through the magnet carrier 215 and the conductor 200 to magnetize the bit 170. In order to demagnetize the bit 170, the operator may slide the sleeve 130 toward the shank 110 of the bit holder 100, which moves the magnet 205 and the magnet carrier 215 away from the conductor 200.

In another embodiment of the invention (not shown), the switch may consist of a magnet carrier located within the cavity and between the conductor and the magnet, a guiding bar, a longitudinal groove on one side of the bit holder, and a thumb grip. The magnet carrier may be comprised of a material, including but not limited to steel. Magnetic force attracts the magnet to the magnet carrier so that the magnet and magnet carrier move as a single unit within the cavity. Magnetic force from the magnet may also be transmitted through the magnet carrier to the conductor and ultimately through the conductor to the bit. The guiding bar may be a straight piece of metal, plastic, wood, or other reasonable material that is longer than it is wide. The shape of the cross-sectional area of the guiding bar may be, but is not limited to, spherical, square, rectangular, or oval. The longitudinal groove may have a length less than the length of the cavity and a width slightly greater than the circumference of the guiding bar. The thumb grip may be made of various materials, including but not limited to metal, plastic, or rubber.

The guiding bar may be inserted into a hole in the center of the magnet carrier that extends across the width of the magnet carrier. The guiding bar may be connected to the magnet carrier by threading, epoxy, threading and epoxy, pressure fitting, or any other reasonable method. The manner in which the guiding bar is connected to the magnet carrier is not essential to the invention, and any suitable method may be used and still be within the scope of the invention. One end of the guiding bar may extend through the longitudinal groove and may be connected to the thumb grip by threading, tack welding, pressure fitting, or any other reasonable method. Thus, when the operator slides the thumb grip toward the socket of the bit holder, the magnet carrier may be placed in contact with or adjacent to the conductor, and magnetic force from the magnet may be transmitted through the magnet carrier and the conductor to magnetize the bit. In order to demagnetize the bit, the operator may slide the thumb grip toward the shank of the bit holder, which moves the magnet and the magnet carrier away from the conductor.

An alternate embodiment of the invention may be a magnetic driver that is capable of receiving and positioning a fastener without the use of a bit. The embodiment further includes devices and methods for demagnetizing the socket of the driver so that metallic debris that may interfere with the seating of the fastener within the socket can be removed quickly and easily. The socket may also be magnetized and demagnetized to facilitate the removal of metallic debris that accumulates as the fastener is placed in the base material.

This embodiment may comprise a driver with a shank at one end of the driver, a socket at the opposite end of the driver, and a body between the shank and the socket. The type of driver is not significant to the inventive concept and may include, but is not limited to, a nut or hex driver. The socket of the driver may be elongated, flared, or otherwise configured to receive an end of a fastener while the opposite end of the fastener may be positioned against the base material to be fastened. The type of fastener is not significant to the inventive concept and may include, but is not limited to, a screw, nut, or bolt. The remaining structural characteristics of the magnetic driver, including the cavity, magnet, switch, and conductor, are identical to those of the magnetic bit holder as previously described. The magnetic driver is designed to permit the removal of metallic debris from the socket so that the fastener can be properly seated within the socket. The magnetic driver may also facilitate the removal of metallic debris from the socket and fastener as the fastener is placed.

As can be seen, the invention provides devices and methods for magnetizing or demagnetizing a bit inserted in a bit holder without removing the bit from the bit holder and for magnetizing or demagnetizing the socket of a driver. More particularly, the invention comprises a bit holder or driver with a cavity containing a magnet. The magnet is attached to a switch which allows the magnet to move within the cavity to an "on" or an "off" position. The bit or driver is magnetized when the magnet is in the "on" position and demagnetized when the magnet is in the "off" position.

From the foregoing, it will be understood by persons skilled in the art that a magnetic bit holder or driver with switch has been provided. The invention is relatively simple and easy to manufacture, yet affords a variety of uses. While the description contains many specifics, these should not be construed as limitations on the scope of the invention, but rather as an exemplification of the preferred embodiments thereof. The foregoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A switch for moving a magnet within a cavity of a body of a magnetic bit holder, the switch comprised of a magnet carrier located within the cavity and between the magnet and a conductor;

a guiding bar located in a hole in the magnet carrier, the guiding bar having ends and a circumference;

longitudinal grooves in the body through which the ends of the guiding bar extend; and a sleeve which surrounds a portion of the body and is attached to the ends of the guiding bar, wherein magnetic force attaches the magnet to the magnetic carrier so that the magnet and the magnet carrier move as a unit.

2. A switch according to claim 1, wherein the longitudinal grooves are located on opposite sides of the body.

3. A switch according to claim 1, wherein the longitudinal groove has a length no greater than a length of the cavity.

4. A switch according to claim 1, wherein the longitudinal groove has a width that is slightly greater than the circumference of the guiding bar.

5. A switch for moving a magnet within a cavity of a body of a magnetic bit holder, the switch comprised of a magnet carrier located within the cavity and between the magnet and a conductor;

a guiding bar located in a hole of the magnet carrier, the guiding bar having an end and a circumference;

a longitudinal groove in the body through which the end of the guiding bar extends; and a thumb grip which slides along the body and attaches to the end of the guiding bar, wherein magnetic force attaches the magnet to the magnetic carrier so that the magnet and the magnet carrier move as a unit.

6. A magnetic driver comprising a driver having a first end comprising a shank, a second end comprising a socket to receive a fastener, and a body therebetween;

a cavity inside the body, the cavity having a length;

a magnet inside the cavity, the magnet having a center and a width;

a switch adapted to move the magnet within the cavity; and a conductor located between the cavity and the socket, wherein the conductor transmits magnetic force to the socket when the magnet abuts the conductor.

7. The magnetic driver described in claim 6, wherein the switch is comprised of a guiding bar located in a hole in the center of the magnet, the guiding bar having ends and a circumference;

longitudinal grooves in the body through which the ends of the guiding bar extend; and a sleeve which surrounds a portion of the body, wherein each end of the guiding bar extends through a longitudinal groove and attaches to the sleeve.

8. The magnetic driver described in claim 6, wherein the switch is comprised of a magnet carrier located within the cavity and between the magnet and a conductor;

a guiding bar having ends and a circumference, the guiding bar located in a hole in the magnet carrier;

longitudinal grooves in the body through which the ends of the guiding bar extend; and a sleeve which surrounds a portion of the body and is attached to the ends of the guiding bar, wherein magnetic force attaches the magnet to the magnetic carrier so that the magnet and the magnet carrier move as a unit.

9. The magnetic driver described in claim 6, wherein the switch is comprised of a spring in the cavity of the body having a first end and a second end, wherein the first end is attached to the body and the second end is in contact with a first surface of the magnet; and a push button comprised of a push button head attached to a push button stem, the push button stem extending through an opening in the body and having a surface that is in contact with a second surface of the magnet, wherein the spring is compressed when the push button head is held against the body of the driver.

10. The magnetic driver described in claim 9, wherein the surface of the push button stem that is in contact with the second surface of the magnet is formed at an angle that complements an angle of the second surface of the magnet.

11. The magnetic driver described in claim 9, wherein a portion of the body and the push button head are surrounded by a covering.

12. The magnetic driver described in claim 6, wherein the switch is comprised of a guiding bar having an end and a circumference;

a longitudinal groove in the body through which the end of the guiding bar extends; and a thumb grip which slides along the body and attaches to the end of the guiding bar, wherein the end of the guiding bar passes through the longitudinal groove and attaches to the thumb grip.

13. The magnetic driver described in claim 12, wherein the guiding bar is located in a hole in the center of the magnet.

14. The magnetic driver described in claim 12, wherein the guiding bar is located in a hole in a magnet carrier, wherein the magnet carrier is located inside the cavity and between the conductor and the magnet.

15. The magnetic driver described in claim 6, wherein the socket is configured to receive a fastener.

16. A method of using a magnetic driver, the method comprising the steps of providing a driver having a first end comprising a shank, a second end comprising a socket to receive a fastener, and a body therebetween, wherein the body is comprised of a cavity, a magnet inside the cavity, and a conductor located between the cavity and the socket;

demagnetizing the socket by positioning a switch that is attached to the magnet so that the magnet is not adjacent to the conductor;

removing metallic debris from the socket;

placing the fastener into the socket;

magnetizing the socket by positioning the switch so that the magnet is adjacent to the conductor; and using the driver to manipulate the fastener.

17. A method according to claim 16, wherein the switch is comprised of a guiding bar located in a hole in a center of the magnet, the guiding bar having ends and a circumference;

longitudinal grooves in the body through which the ends of the guiding bar extend; and a sleeve which surrounds a portion of the body, wherein each end of the guiding bar extends through a longitudinal groove and attaches to the sleeve.

18. A method according to claim 16, wherein the switch is comprised of a magnet carrier located within the cavity and between the magnet and a conductor;

a guiding bar having ends and a circumference, the guiding bar located in a hole in the magnet carrier;

longitudinal grooves in the body through which the ends of the guiding bar extend; and a sleeve which surrounds a portion of the body and is attached to the ends of the guiding bar, wherein magnetic force attaches the magnet to the magnetic carrier so that the magnet and the magnet carrier move as a unit.

19. A method according to claim 16, wherein the switch is comprised of a spring in the cavity of the body having a first end and a second end, wherein the first end is attached to the body and the second end is in contact with a first surface of the magnet; and a push button comprised of a push button head attached to a push button stem, the push button stem extending through an opening in the body and having a surface that is in contact with a second surface of the magnet, wherein the spring is compressed when the push button head is held against the body of the driver.

20. A method according to claim 16, wherein the switch is comprised of a guiding bar having an end and a circumference;

a longitudinal groove in the body through which the end of the guiding bar extends; and a thumb grip which slides along the body and attaches to the end of the guiding bar, wherein the end of the guiding bar passes through the longitudinal groove and attaches to the thumb grip.

* * * * *